US007603768B2

(12) United States Patent
Viviroli

(10) Patent No.: US 7,603,768 B2
(45) Date of Patent: Oct. 20, 2009

(54) INSPECTION APPARATUS FOR WIRE-PROCESSING MACHINE

(75) Inventor: Stefan Viviroli, Horw (CH)

(73) Assignee: Komax Holding AG, Dierikon (CH)

( * ) Notice: Subject to any disclaimer, the term of this patent is extended or adjusted under 35 U.S.C. 154(b) by 377 days.

(21) Appl. No.: 10/938,024

(22) Filed: Sep. 9, 2004

(65) Prior Publication Data

US 2005/0050722 A1 Mar. 10, 2005

(30) Foreign Application Priority Data

Sep. 10, 2003 (EP) ..... 03405664
Aug. 26, 2004 (EP) ..... 04405534

(51) Int. Cl.
*B23P 19/00* (2006.01)

(52) U.S. Cl. ..... 29/753; 29/566.2; 29/566.4; 29/33 M; 72/418

(58) Field of Classification Search ..... 29/729, 29/745–748, 564.4, 33 M, 751, 828, 867; 174/84 R, 84 C, 94 R; 81/9.51; 83/113, 83/76.8, 947; 140/1, 71 R, 107; 72/19.6, 72/18.9, 20.1, 21.4, 327, 418

See application file for complete search history.

(56) References Cited

U.S. PATENT DOCUMENTS 4,819,533 A * 4/1989 Wollermann et al. ..... 83/154
4,852,433 A * 8/1989 Butler ..... 81/9.51
4,873,901 A * 10/1989 Stoehr ..... 81/9.51
4,951,369 A * 8/1990 Verrall ..... 29/33 M
5,025,549 A 6/1991 Hornung et al.
5,058,260 A 10/1991 Gloe et al.
5,067,379 A * 11/1991 Butler et al. ..... 83/13
5,092,026 A 3/1992 Klemmer et al.
5,271,254 A 12/1993 Gloe et al.
5,490,316 A * 2/1996 Kimoto ..... 29/564.4
5,491,994 A 2/1996 Baldyga
5,522,130 A 6/1996 Wollermann
5,526,717 A 6/1996 Koch
5,784,770 A * 7/1998 Long et al. ..... 29/564.4
5,797,299 A 8/1998 Long, Jr.
5,887,469 A 3/1999 Maeda et al.
5,921,125 A 7/1999 Inoue et al.
5,937,505 A 8/1999 Strong et al.
6,212,924 B1 4/2001 Meisser
6,230,386 B1 * 5/2001 Hasegawa ..... 29/564.4
6,418,768 B2 7/2002 Meisser et al.
6,418,769 B1 7/2002 Schreiner
6,487,885 B2 12/2002 Meisser et al.
6,659,140 B2 * 12/2003 Yamakawa ..... 140/71 R (Continued)

FOREIGN PATENT DOCUMENTS

EP 0 623 982 11/1994

(Continued)

*Primary Examiner*—Minh Trinh
(74) *Attorney, Agent, or Firm*—Fraser Clemens Martin & Miller LLC; William J. Clemens

(57) ABSTRACT

A wire-processing apparatus has grippers feeding a wire to processing stations for producing wire end connections. A holder is used to inspect the wire end connection, wherein the linear movement of the grippers is used for the automated inspection of the wire end connection by applying a pull out force along a longitudinal axis of the wire while the holder is retaining the connection.

16 Claims, 6 Drawing Sheets

U.S. PATENT DOCUMENTS

| | | | | |
|---|---|---|---|---|
| 6,782,607 | B2 * | 8/2004 | Pfautz et al. | 29/745 |
| 6,877,208 | B2 * | 4/2005 | Shirakawa et al. | 29/564.2 |
| 6,910,256 | B2 | 6/2005 | Locher et al. | |
| 6,961,992 | B2 * | 11/2005 | Conte | 29/753 |
| 7,140,215 | B2 * | 11/2006 | Viviroli et al. | 29/753 |
| 2005/0050722 | A1 | 3/2005 | Viviroli | |

FOREIGN PATENT DOCUMENTS

| | | |
|---|---|---|
| EP | 0 623 982 | 11/2004 |
| WO | WO 9717751 | 5/1997 |

* cited by examiner

INSPECTION APPARATUS FOR WIRE-PROCESSING MACHINE

BACKGROUND OF THE INVENTION

The present invention concerns an inspection apparatus and a procedure for a wire-processing machine with processing stations for electrical wire outfitting, where at least one gripper as a furnishing unit feeds the wire to the processing station.

Known facilities for inspecting a crimp connection consist of a holder for holding the crimp contact and of a pulling device for loading the wire connected to the crimp contact by way of a stripping crimp and a conductor crimp with a force in the direction of the longitudinal axis of the cable. The inspection facilities can be operated manually or by motor, where the measured holding force is displayed by means of force sensors. If the crimp connection does not or only partially withstands a predetermined pull out force, the wire is manually discarded.

The disadvantage of the known inspection facilities is that they cannot be integrated in an automated wire-processing process, at least without great effort.

SUMMARY OF THE INVENTION

The present invention solves the task of avoiding the disadvantages of the known facilities and creates a wire-processing apparatus the makes inspecting an electrical wire end connection within an automated wire-processing procedure feasible.

The present invention concerns an inspection apparatus for a wire-processing machine having processing stations for wire outfitting wherein at least one gripper feeds wire to the processing stations for producing a wire end connection. The apparatus includes a holder for releasably retaining a contact attached to an end of a wire held by the gripper; and means for moving the at least one gripper with a linear movement to generate a pull out force along a longitudinal axis of the wire relative to the contact. The holder includes a pair of opposed retaining plates attached to slides movable on a bracket for moving the retaining plates between a closed position retaining the contact and an open position releasing the contact. The retaining plates each have a V-shaped free end for holding the contact in the closed position. At least one force sensor is mounted on the holder and wherein the pull out force is transferred to the retaining plates for detection by the at least one force sensor.

The present invention also concerns an inspection method for operating a wire-processing apparatus having processing stations for wire outfitting wherein at least one gripper feeds wire to the processing stations comprising the steps of: a) moving the at least one gripper with a linear movement to feed the wire to one of the processing stations and attaching a contact at an end of the wire; b) moving the wire and the attached contact away from the one processing station; and c) moving the at least one gripper with the linear movement for inspecting a connection between the wire and the attached contact. Step c) can be performed by releasably retaining the contact in a holder while operating the at least one gripper to hold the wire and load the wire by the linear movement with a pull out force along a longitudinal axis of the wire. The method can include a step of measuring the pull out force with at least one force sensor or determining the pull out force by measuring a motor current of an electric motor providing the linear movement.

The main advantages achieved by the present invention are that already existing modules of the wire-processing facility can be used to inspect the wire end connection produced in the automated wire-processing operation. For an automated wire-processing operation, grippers arranged at swivel arms for example or grippers arranged at transfer facilities are used to feed the wire to the processing stations. The gripper is not only moved in a circle, or in the transfer direction, but also linearly in the swiveling arm longitudinal axis, or crosswise to the transfer direction. The linear movement going horizontally into the depth of the wire-processing facility or the crosswise movement of the gripper is necessary for supplying wires to different crimp contacts, feeding wires with grommets or supplying wires to relegated processing stations, for example. For the wire-processing facility per the present invention, the linear movement of the gripper is not only used for feeding the wire to the processing stations, but also for the automated inspection of the wire end connection. The wire end connection is fed to a holder and is held by it. The gripper grasps the wire, or rather firmly holds the wire and loads the wire with a pull out force in the longitudinal axis of the wire by means of a linear movement away from the holder. With the multiple use or the linear movement of the gripper used for different purposes, the wire-processing facility can be set up more easily and operated more productively with better quality assurance.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
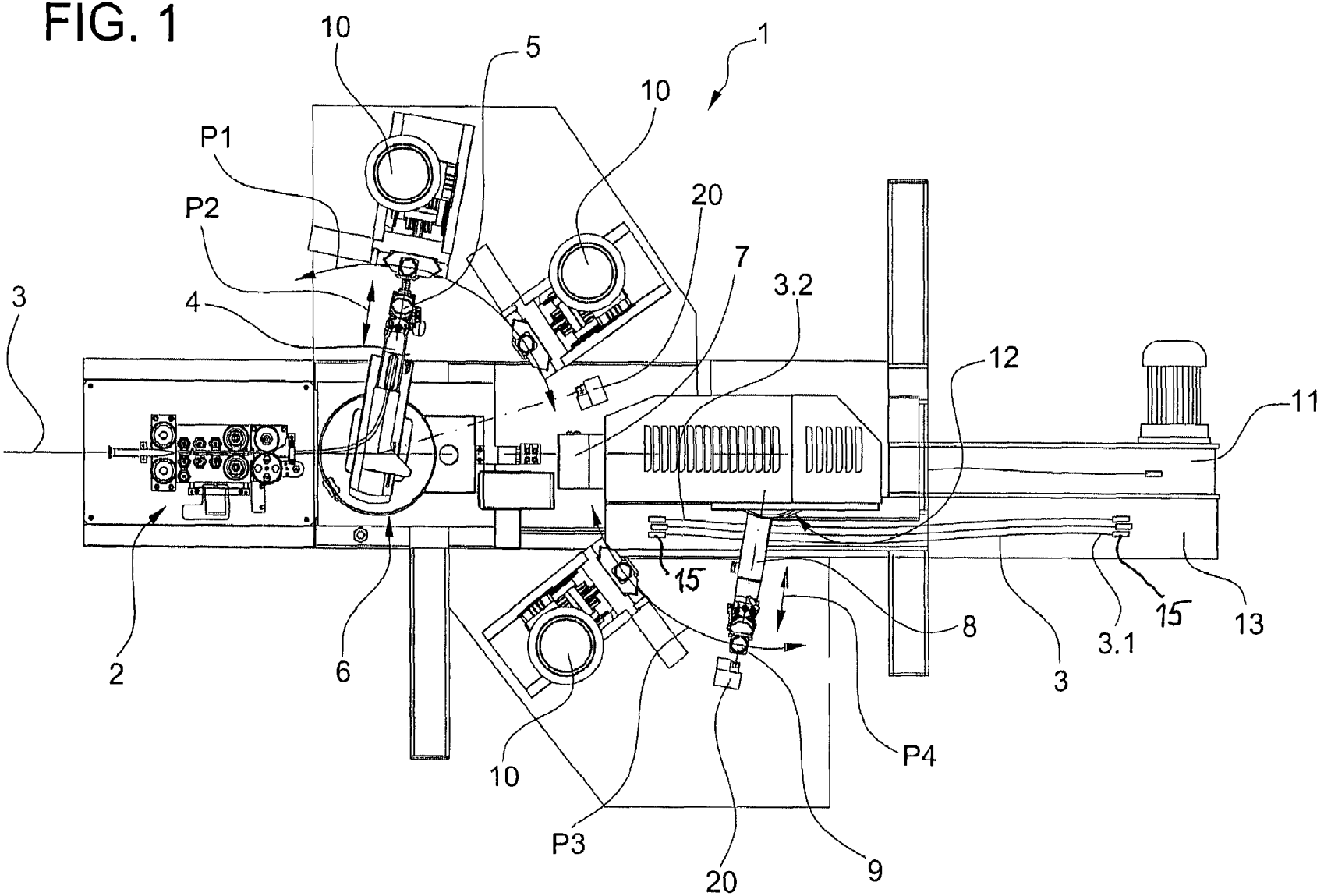
FIG. 1 is a top plan view of a wire-processing apparatus according to the present invention having two swivel arms.

FIG. 1 shows a wire-processing machine 1 with a wire advance means provided as a belt drive 2, wherein the belt drive 2 feeds a wire 3 to a first swivel arm 4 with a first gripper 5. Through a first drive means 6, the first swivel arm 4 can be operated in a swinging movement symbolized with an arrow P1 and/or a linear movement symbolized with an arrow P2. The wire 3 can be separated and stripped with knives 7.

Furthermore, the wire-processing apparatus 1 includes a second swivel arm 8 with a second gripper 9. Through a second drive means 12, the second swivel arm 8 can be operated in a swinging movement symbolized with an arrow P3, and/or a linear movement symbolized with an arrow P4. The first swivel arm 4 serves as a furnishing facility by means of the turning movement P1 and the linear movement P2 at processing stations 10 arranged at the opposite sides of the longitudinal axis of the wire 3 (for example, crimp presses and/or grommet assembly) for leading end 3.1. The second swivel arm 8 that was set into motion by means of the second drives 12 serves as a furnishing facility by means of the turning movement P3 and the linear movement P4 at the processing stations 10 arranged at opposite sides of the longitudinal axis of the wire 3 (for example, crimp presses and/or grommet assembly) for lagging end 3.2. After processing the leading end 3.1, the wire 3 is transported along by means of a transport belt 11. The second gripper 9 grasps the lagging end 3.2, the wire 3 is separated and the lagging end 3.2 is stripped and fed to one of the processing stations 10. After processing the lagging end 3.2, the wire 3 is moved to a deposit station 13.

A holder 20 is used to inspect the wire connections produced in the automated wire-processing operation (such as the crimp connection between a crimp contact 15 and the wire 3). It is also possible to inspect other wire connections, such as soldered connections. Each of two of the holders 20 is arranged in the swiveling area of an associated one of the grippers 5, 9. The crimp contact 15 is fed to the holder 20 by the gripper 5, 9 and is held by it. The gripper 5, 9 grasps the wire ends 3.1, 3.2, that is, it holds the wire ends 3.1, 3.2 and loads wire 3 with a pull out force AK along the longitudinal axis of the wire by means of the linear movement P2, P4 away from the holder 20. The pull out force AK exerted on the cable 3 is measured, for example, using at least one force sensor arranged on the holder 20 or by means of the motor current of a motor of the drives 6, 12. The controls of the wire-processing apparatus 1 specify the pull out force and record the measured pull out force AK for statistical or control-technical purposes, for example.

The gripper 5, 9 that furnishes the wire 3 with the crimp contact 15 executes a linear movement with limited current. The current limit corresponds to the pull out force AK. If the pull out force AK or the current limit is not achieved, then this means that the crimp connection did not withstand the required pull out force AK; the wire crimp is faulty.

For a failed pull out test, an error message is triggered and the processing apparatus is stopped by the controls.

A knife head of the separator/stripper knife 7 can also be used as a holder, where the retaining plates for holding the wire end contact are moveable by means of the knife drive.

Figure 2:
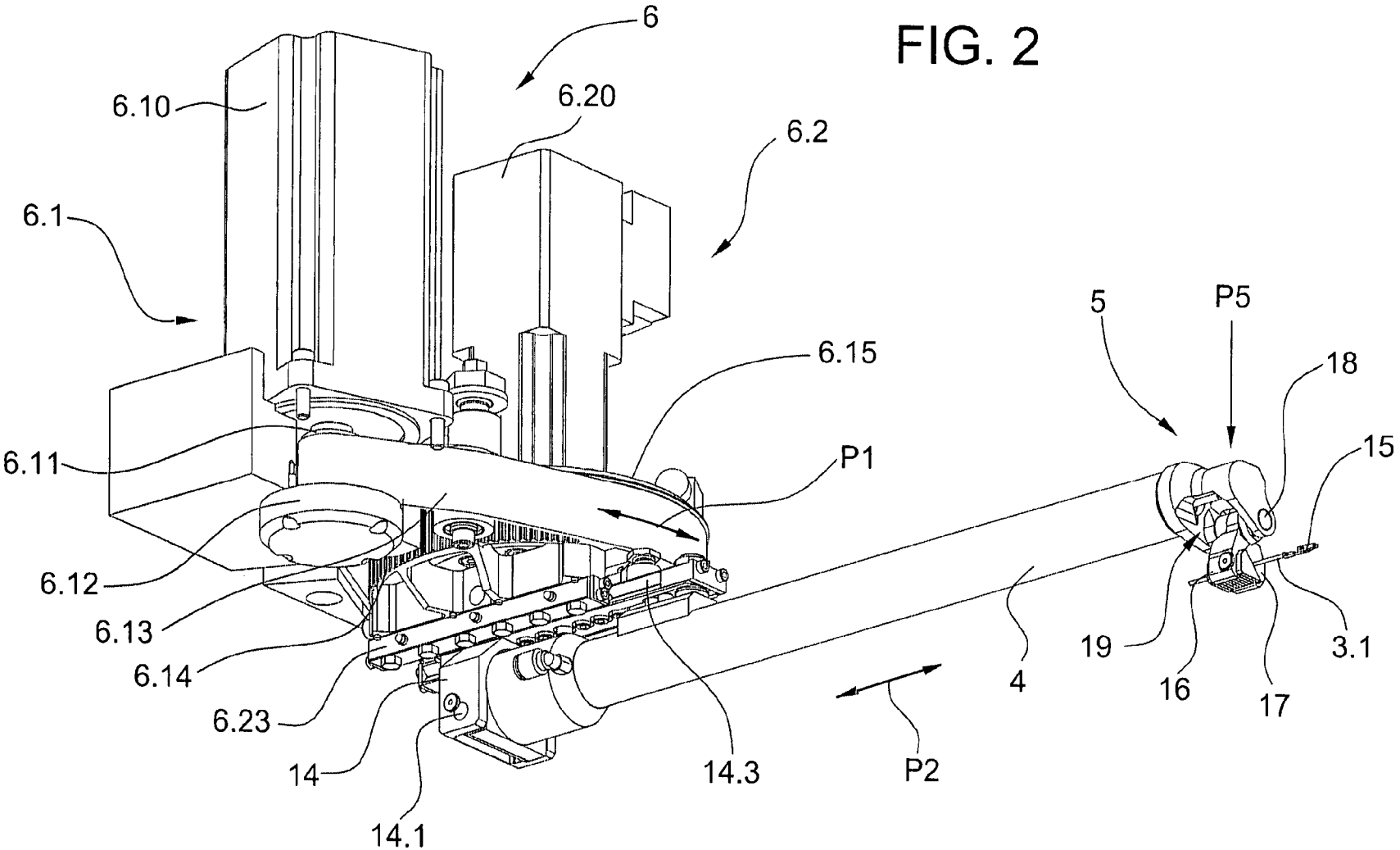
FIG. 2 is an enlarged perspective view of one of the swivel arms shown in FIG. 1 with gripper.

FIG. 2 shows details of the first swivel arm 4 with the first gripper 5. The configuration of the second swivel arm 8 with the second gripper 9 is identical to the configuration of the first swivel arm 4 with the first gripper 5. The first drive means 6 consists of a first drive 6.1 for the swivel movement P1 and a second drive 6.2 with a motor 6.20 for the linear movement P2 of the swivel arm 4. The drive 6.1 has an actuating drive pinion 6.11 rotated by a motor 6.10, wherein a rotary encoder 6.12 records the pinion movement. The turning movement of the drive pinion 6.11 is transferred to a belt pulley 6.14 by a belt 6.13, which belt is a component of a rotary table 6.15 to which the drive 6.2 is coupled for the linear movement P2 of the swivel arm 4. The first swivel arm 4 is suspended at a housing 14 in a rotating position about an axis 14.1, where a spring tension loads the swivel arm 4 in a counter-clockwise direction. To lay the stripped leading end 3.1 in the crimp contact 15, for example, a force P5 exerted by the crimp press on the gripper 5 opposes the spring tension during the crimp procedure, wherein the swivel arm 4 executes a turning movement in a clockwise direction with the gripper 5. The leading end 3.1 is held by a first gripper jaw 16 and a second gripper jaw 17 of the gripper 5. The rotating jaws 16, 17 are arranged on an axis 18 and are opened and closed by means of a gear 19.

Figure 3:
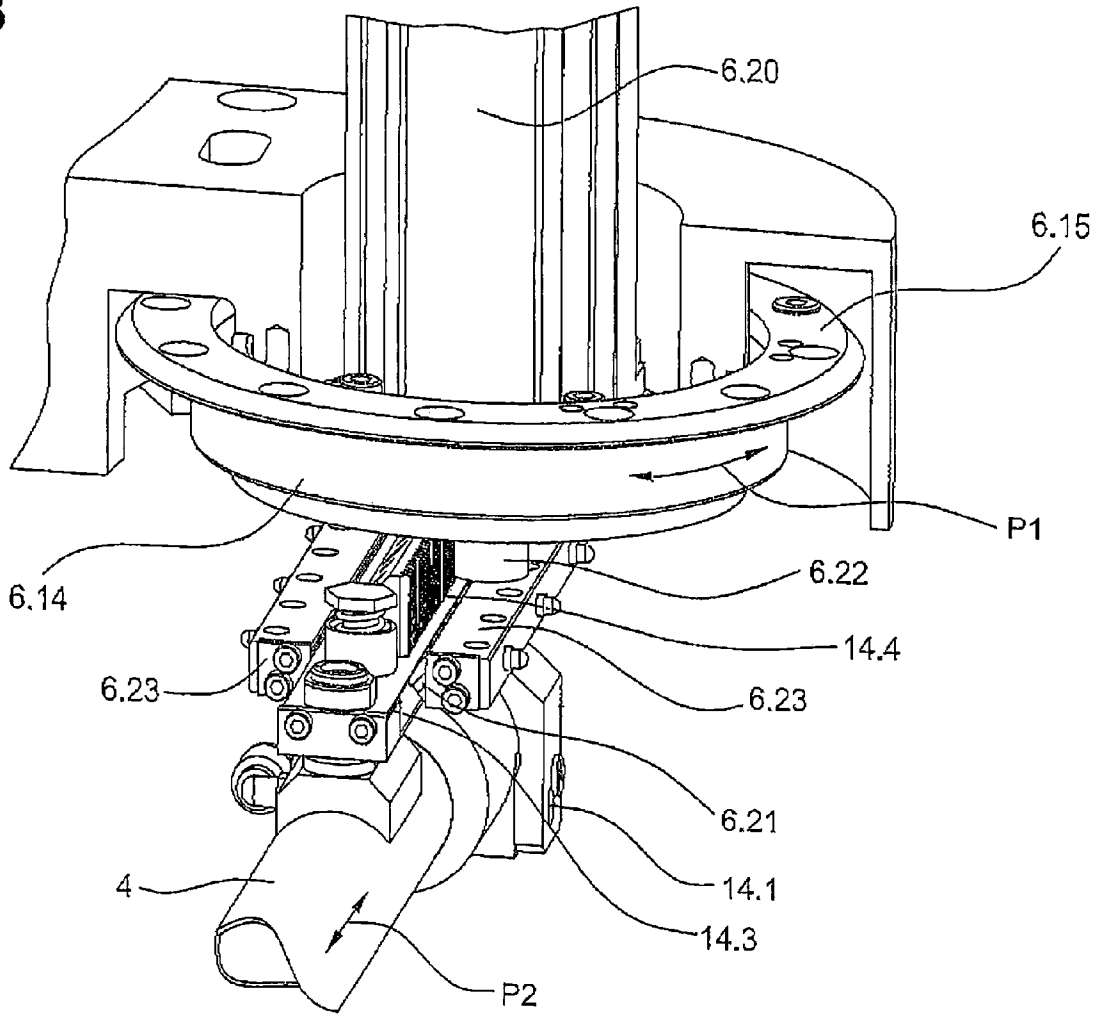
FIG. 3 is a perspective view of the swivel arm linear drive shown in FIG. 2.

FIG. 3 shows the drive 6.2 for the linear movement P2 of the swivel arm 4. The swivel arm 4 is guided by linear guide rails 6.23 attached to the rotating table 6.15, where a prism-shaped bearing 6.21 guides a linear guide 14.3 of the swivel arm 4. A toothed pinion 6.22 of the motor 6.20 is arranged at the rotating table 6.15 and engages in a toothed rack 14.4 arranged at the linear guide 14.3, wherein the rotational movement of tooth pinion 6.22 is converted to the linear movement P2.

The holder 20 can also be used in a wire-processing apparatus with a series of arranged processing stations and linear maneuverable gripper units, such as is shown in the European patent EP 1 073 163 B1. The gripper can move in a linear transfer direction and crosswise to the linear transfer direction. For the holding device 20 that is arranged at the end of the series of processing stations, for example, the crimp contact is fed in the transfer direction and in a crosswise linear movement by means of the grippers and a linear movement and is held by this. The gripper grasps the wire end and loads the wire with a force in the longitudinal axis of the cable by means of a linear movement away from the holder 20.

Figure 4:
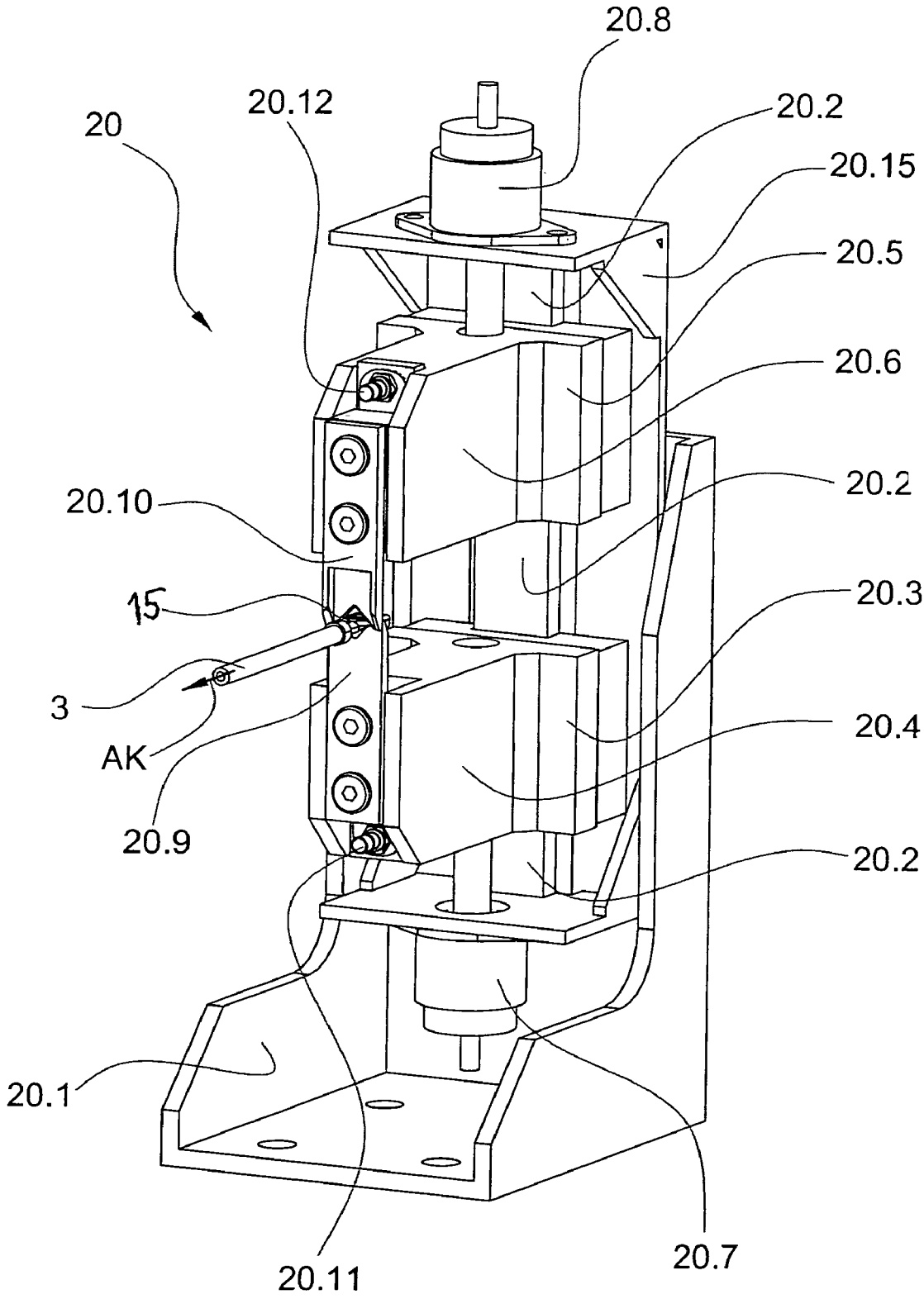
FIG. 4 is a perspective view of the clamping fixture for holding a wire end contact shown in FIG. 1.
Figure 5:
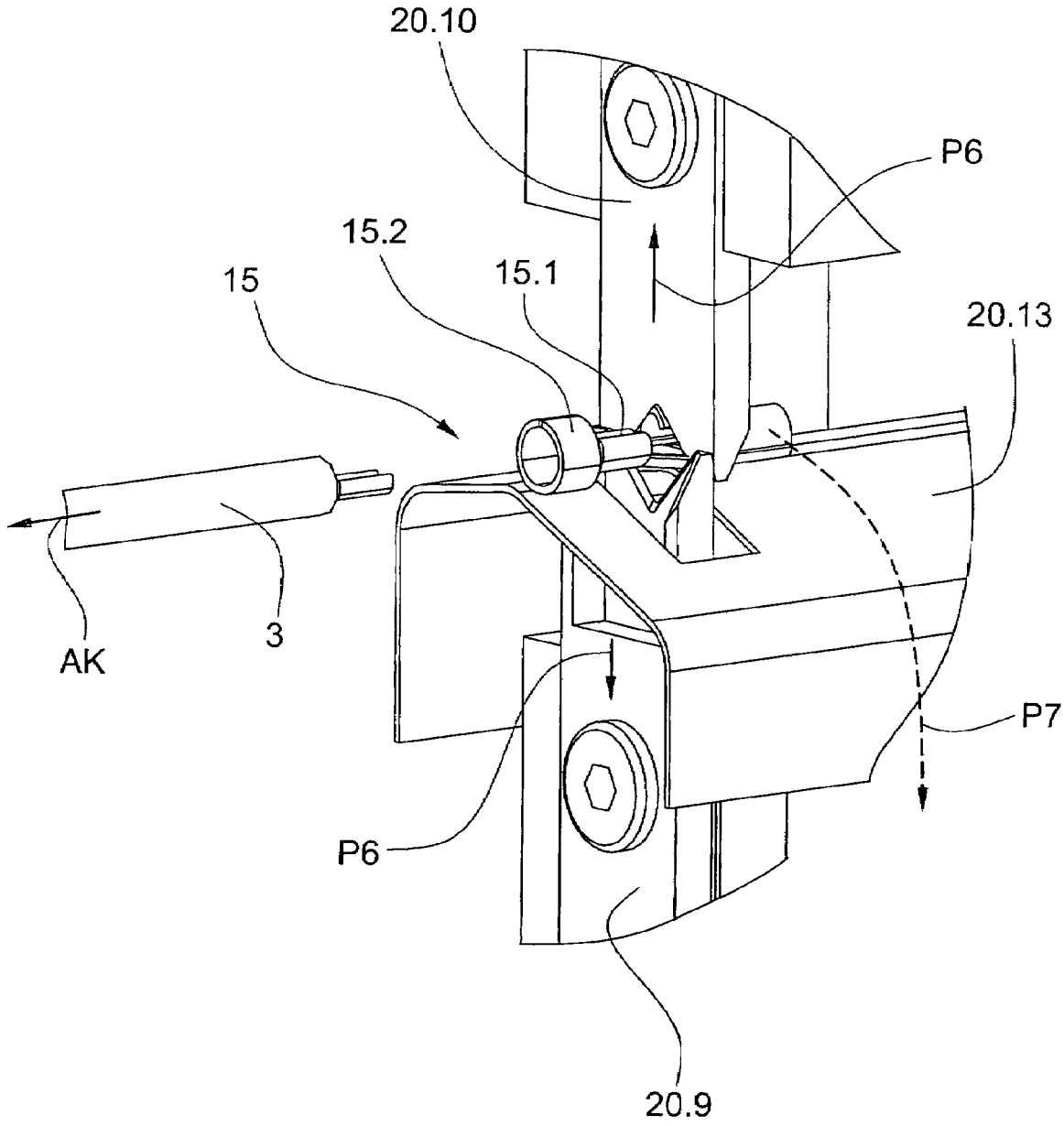
FIG. 5 is an enlarged fragmentary perspective view of details of the clamping fixture shown in FIG. 4.

FIG. 4 shows the holder 20 and FIG. 5 shows the details of the holder 20 for holding the wire end connection, or the crimp contact 15 with the wire 3. A slip-in guide 20.2 arranged on a support 20.15 of a housing 20.1 guides a lower slide 20.3 with a bracket 20.4 and an upper slide 20.5 with a bracket 20.6. The lower slide 20.3 is driven by a lower drive 20.7 and the upper slide 20.5 is driven by an upper drive 20.8. The drives 20.7, 20.8 could be electrical or pneumatic drives, for example. A lower retaining plate 20.9 is at the lower bracket 20.4 and an upper retaining plate 20.10 is at the upper bracket 20.6, wherein the retaining plates 20.9, 20.10 can carry out an opening or closing movement by means of the counter-moving slides 20.3, 20.5. The retaining plates 20.9, 20.10 are V-shaped at adjacent free ends and hold the crimp contact 15 with the wire 3 after a closing movement. The pull out force AK engages at the retaining plates 20.9, 20.10 and is transferred to a lower force sensor 20.11 or an upper force sensor 20.12.

FIG. 5 shows the example of a wire end connection, or crimp connection that did not withstand the specified pull out force AK. The pull out force AK measured by means of the force sensors 20.11, 20.12, or the current of the drive 6.20 has not been achieved and a conductor crimp 15.1 is faulty. When opening the retaining plates 20.9, 20.10 (symbolized by an arrow P6), the crimp contact 15 drops (symbolized by an arrow P7) over a work sheet 20.13 in a container (not depicted).

Figure 6:
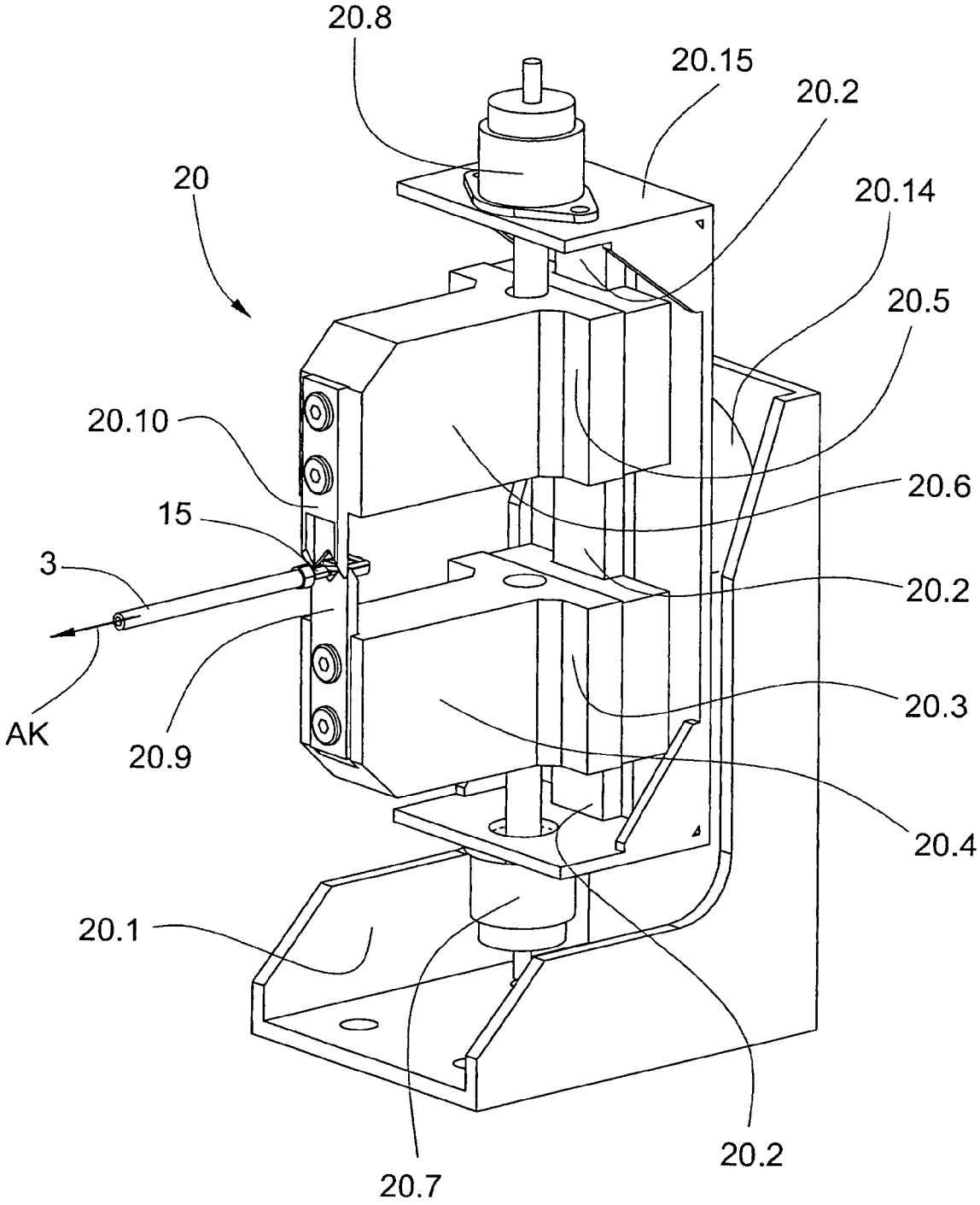
FIG. 6 is a holder for holding the wire end connector.

FIG. 2 shows how the gripper 5 grasps the wire 3, or holds it for loading the wire 3 with the pull out force AK. FIGS. 4 to 6 show how the wire end contact, or the crimp contact 15 is held during the pull out test.

FIG. 6 shows the holder 20 where the pull out force AK is being measured by a force sensor 20.14. The force sensor 20.14 is arranged between the housing 20.1 and the support 20.15, wherein the pull out force AK is transferred to the support 20.15 and from there to the force sensor 20.14 and from there to the housing 20.1. The brackets 20.4, 20.6 can also have the retaining plates 20.9, 20.10, wherein the free ends of the retaining plate pairs (upper and lower retaining plates) are different depending on the wire end contact to be held. The V-shaped ends can vary in shape and size, or can be shaped differently, where the ends of the retaining plates 20.9, 20.10 guide the wire 3 during the closing movement comparable to the V-shaped ends.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An inspection apparatus for a wire-processing machine having processing stations for wire outfitting wherein at least one gripper feeds wire to the processing stations for producing a wire end connection, comprising:

a holder for releasably retaining a contact attached to an end of a wire held by the gripper; and means for moving the at least one gripper with a linear movement in a direction parallel with a longitudinal axis of the wire to generate a pull out force along the longitudinal axis of the wire relative to the contact while said holder is retaining the contact.

2. The inspection apparatus according to claim 1 wherein said holder includes a pair of opposed retaining plates attached to slides movable on a bracket for moving said retaining plates between a closed position retaining the contact and an open position releasing the contact.

3. The inspection apparatus according to claim 2 wherein said retaining plates each have a V-shaped free end for holding the contact in the closed position.

4. The inspection apparatus according to claim 2 including at least one force sensor mounted on said holder and wherein the pull out force is transferred to said retaining plates for detection by said at least one force sensor.

5. An inspection apparatus for a wire-processing machine having processing stations for wire outfitting comprising:

a gripper feeding a wire to the processing stations for producing a wire end connection;

a holder releasably retaining a contact attached to an end of the wire fed by said gripper; and means for moving said gripper with a linear movement relative to said holder in a direction parallel with a longitudinal axis of the wire to generate a pull out force along the longitudinal axis of the wire relative to the contact while said holder is retaining the contact.

6. The inspection apparatus according to claim 5 wherein said holder includes a pair of opposed retaining plates attached to slides movable on a bracket for moving said retaining plates between a closed position retaining the contact and an open position releasing the contact.

7. The inspection apparatus according to claim 6 wherein said retaining plates each have a V-shaped free end for holding the contact in the closed position.

8. The inspection apparatus according to claim 6 including at least one force sensor mounted on said holder and wherein the pull out force is transferred to said retaining plates for detection by said at least one force sensor.

9. An inspection apparatus for a wire-processing machine having processing stations for wire outfitting, comprising:

a swivel arm configured for a swinging movement and a linear movement;

a gripper for feeding a wire to the processing stations to produce a wire end connection, the wire having a contact attached to an end of the wire, the gripper disposed at an end of the swivel arm and configured to selectively grasp the wire and selectively move in a direction parallel with a longitudinal axis of the wire;

a holder releasably retaining the contact of the wire fed by said gripper, the holder including a pair of opposed retaining plates attached to slides movable on a bracket for moving said retaining plates between a closed position retaining the contact and an open position releasing the contact, the retaining plates each having a V-shaped free end for holding the contact in the closed position;

a drive means coupled to the swivel arm and configured to move the gripper with the linear movement relative to the holder in a direction parallel with the longitudinal axis of the wire, the drive means generating a pull out force along the longitudinal axis of the wire relative to the contact while the gripper is grasping the wire and the holder is retaining the contact; and at least one force sensor mounted on the holder and configured to detect the pull out force on the wire transferred to the retaining plates when the drive means moves the gripper while the gripper is grasping the wire and the holder is retaining the contact.

10. The inspection apparatus according to claim 9, wherein the drive means includes a first drive configured for the swivel movement and a second drive configured for the linear movement of the swivel arm.

11. The inspection apparatus according to claim 10, wherein the first drive includes an actuating drive pinion selectively rotated by a first motor.

12. The inspection apparatus according to claim 11, further including a rotary encoder configured to record movement of the actuating drive pinion.

13. The inspection apparatus according to claim 11, wherein the drive pinion is coupled to a rotary table with a belt, the rotary table coupled to the second drive and configured to provide the swinging movement to the swivel arm.

14. The inspection apparatus according to claim 13, wherein the second drive includes linear guide rails attached to the rotary table, the linear guide rails having a linear guide disposed therebetween, the linear guide coupled to the swivel arm and configured to provide the linear movement thereto.

15. The inspection apparatus according to claim 14, wherein the rotary table is coupled to a toothed pinion, the toothed pinion in communication with a toothed track disposed on the linear guide, a rotational movement of the toothed pinion by the rotary table converted to the linear movement by the toothed track.

16. The inspection apparatus according to claim 14, further including a prism-shaped bearing disposed between the linear guide and the guide rails, the prism-shaped bearing configured to guide the linear guide of the swivel arm.

* * * * *